United States Patent [19]

Lyons

[11] Patent Number: 4,657,038

[45] Date of Patent: Apr. 14, 1987

[54] APPARATUS FOR PREVENTING WATER PIPE FREEZE-UP

[76] Inventor: Kevin D. Lyons, Rte. 2, Box 215 Alachua Way, Alachua, Fla. 32615

[21] Appl. No.: 871,821

[22] Filed: Jun. 9, 1986

[51] Int. Cl.[4] ..... E03B 7/12; F16K 31/70; F16K 31/02

[52] U.S. Cl. ..... 137/62; 137/80; 236/93 R; 237/80; 251/30.02

[58] Field of Search ..... 137/59, 60, 61, 62, 137/80; 237/80; 236/93 R; 251/30.01, 30.02, 30.03

[56] References Cited

U.S. PATENT DOCUMENTS

| | | | |
|---|---|---|---|
| 299,392 | 5/1884 | Jay | 137/62 |
| 944,927 | 12/1909 | Walker | 137/61 |
| 1,003,307 | 9/1911 | Walker | 137/61 |
| 1,028,808 | 6/1912 | Campbell | 137/62 |
| 1,161,013 | 11/1915 | Stewart | 137/62 |
| 1,226,696 | 5/1917 | Ramseur | 137/59 |
| 1,786,878 | 12/1930 | Van Keuren | 137/62 |
| 3,648,715 | 3/1972 | Boothe | 137/62 |
| 4,216,554 | 8/1980 | Glueckert et al. | 137/62 |
| 4,469,118 | 9/1984 | Walters | 137/62 |

FOREIGN PATENT DOCUMENTS

| | | | |
|---|---|---|---|
| 46777 | 9/1939 | Netherlands | 137/62 |

*Primary Examiner*—George L. Walton
*Attorney, Agent, or Firm*—Burns, Doane, Swecker & Mathis

[57] ABSTRACT

An automatic liquid flow control unit is adapted to be attached to an externally threaded spigot to enable liquid to trickle therethrough in order to avoid liquid freeze-up. The unit includes a rigid conduit which includes an internally threaded fastener which can be directly coupled to the threaded spigot. The conduit carries a solenoid actuated valve and a thermal switch which is electrically coupled to the valve to open the latter to a water trickling mode. The thermal switch senses the outside temperature of the conduit and thus is virtually directly responsive to the temperature of liquid within the conduit. The valve can be opened independently of the thermal switch to provide a normal water flow without removal of the unit from the spigot.

7 Claims, 2 Drawing Figures

APPARATUS FOR PREVENTING WATER PIPE FREEZE-UP

BACKGROUND AND OBJECTS OF THE INVENTION

The present invention relates to an apparatus for preventing exterior water conduits from freezing-up during cold weather and, in particular, to an apparatus which allows water to trickle from the conduit in response to a cold temperature being sensed.

Most dwellings are equipped with an external water conduit having a valved spigot to enable water to be accessible for watering vegetation, washing cars, etc. In the event that the ambient temperature descends to such a level that water within the conduit freezes, there exists the danger that the conduit could burst. In many dwellings, especially those without basements, there is no interior shut-off valve within the dwelling to prevent such bursting. One way of preventing the water from freezing in such dwellings involves opening the spigot very slightly to enable the water to continuously trickle from the conduit. Since running water cannot freeze, the danger of conduit bursting is avoided. However, this solution is of little use if the occupant has insufficient warning that the temperature will drop, e.g., an unexpected temperature drop during the night, or if the occupant is absent when the temperature drop occurs. Also, even if the spigot is opened to allow the water to trickle, there will occur a considerable loss of water since the water will be trickling continuously for many hours. This loss will continue even after the ambient temperature rises above the freezing level until the occupant has an opportunity to turn off the spigot (assuming that the occupant remembers to perform this task).

In order to deal with this problem, it has previously been proposed to provide water conduits with a temperature-sensitive valving which automatically opens the conduit when low temperature conditions exist, as exemplified in Jay U.S. Pat. No. 299,392 and Walters U.S. Pat. No. 4,469,118. Those devices, while in place, do not readily permit the spigot to be opened to achieve a normal water flow. Furthermore, each of those devices are actuated in response to ambient air temperature and thus will serve to trickle water when the air temperature is near the freezing temperature of water, even though the temperature of the water in the conduit may be at a higher temperature. Moreover, the device disclosed by Jay includes parts which must be attached to a dwelling wall and thus is relatively difficult to install.

It has been proposed in Van Keuren U.S. Pat. No. 1,786,878 and Stewart U.S. Pat. No. 1,161,013 to provide a mechanism for completely draining a tank of liquid when the liquid temperature reaches a predetermined low level. The temperature sensor is submerged within the liquid itself. Such a mechanism is rather complex and requires the need of a skilled laborer to install. Furthermore, if such a practice were adapted to a water conduit, the presence of a temperature sensor within the conduit would restrict the water flow during normal use of the conduit.

U.S. Pat. Nos. 1,226,696; 3,648,715; and 4,216,554 disclose other forms of temperature-sensitive valving which has been proposed.

It is an object of the present invention to provide a temperature-sensitive valving apparatus which minimizes or obviates problems of the types discussed above.

A further object is to provide such an apparatus which can be easily installed by a person unskilled and unknowledgeable with regard to plumbing.

Another object is to provide such an apparatus which is of simplified construction and enables a full water flow to be selected without removal of the apparatus.

An additional object is to minimize the waste of water by preventing water flow unless warranted by the water temperature itself.

SUMMARY OF THE INVENTION

These objects are achieved by the present invention which relates to an automatic liquid flow control unit adapted to be attached to a liquid line to enable liquid to trickle therethrough in order to avoid liquid freeze-up. The unit comprises a rigid conduit having an inlet which includes a threaded fastener for attaching the inlet to the liquid line. A solenoid-actuated valve is mounted to the conduit downstream of the inlet and is in a normally closed state to prevent the passage of liquid therethrough. The valve includes an electric solenoid connected to an electric circuit so as to be actuable to open the valve to a trickling mode wherein liquid trickles through the conduit. A temperature sensitive switch is mounted against an outer surface of the conduit upstream of the valve and downstream of the fastening means and is arranged for sensing the temperature of the outer surface of the conduit. The temperature sensitive switch is electrically connected to the electrical conduit and the solenoid for actuating the solenoid to open the valve to the liquid-trickling mode in response to the sensed temperature approaching the freezing temperature of the liquid. The valve includes a manual means for actuating the valve independently of the temperature sensitive switch.

THE DRAWINGS

The objects and advantages of the invention will become apparent from the following detailed description of a preferred embodiment thereof in connection with the accompanying drawings in which like numerals designate like elements, and in which:

FIG. 1 is a side elevational view of a water flow control unit according to the present invention; and FIG. 2 is an electric circuit for actuating a valve of the unit depicted in FIG. 1.

DETAILED DESCRIPTION OF A PREFERRED EMBODIMENT OF THE INVENTION

Figure 1:
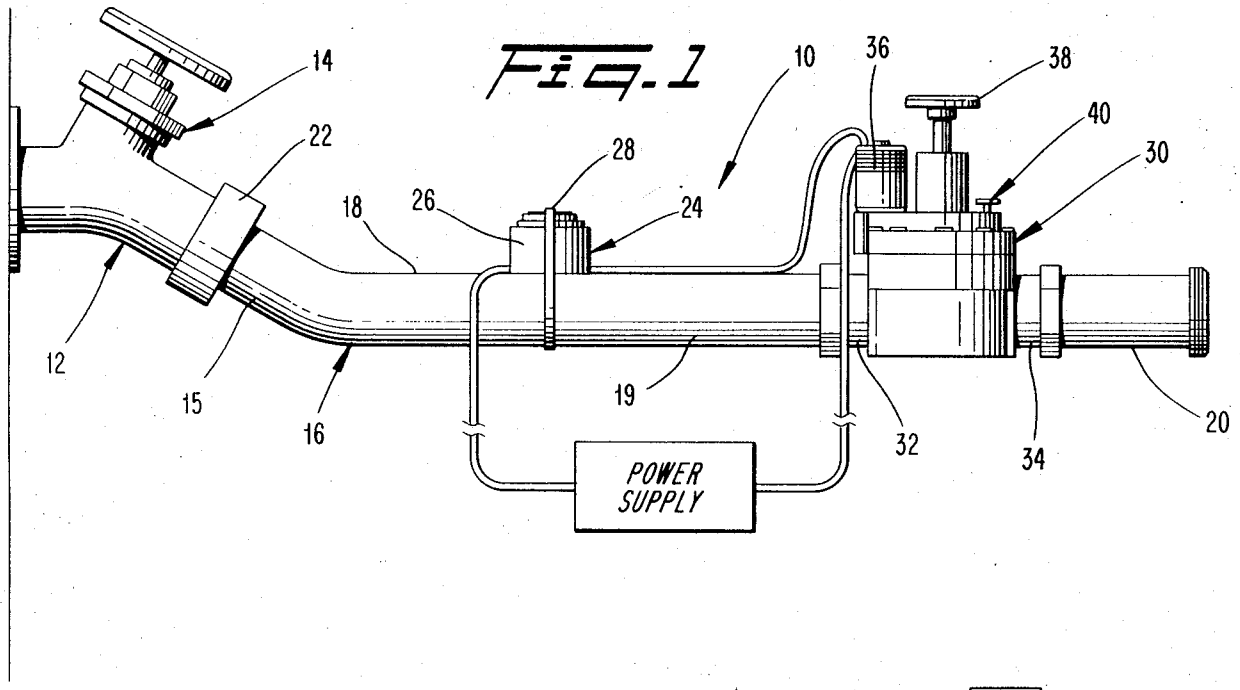
Figure 2:
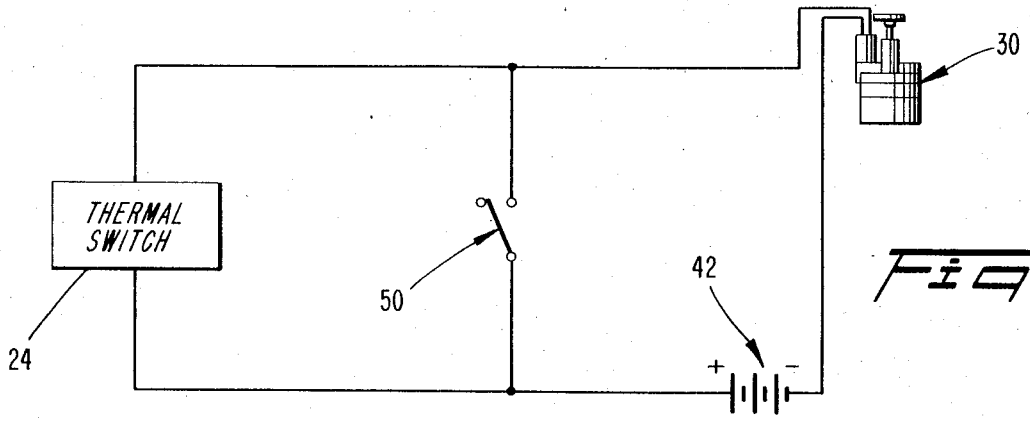

Depicted in FIG. 1 is a water flow control unit 10 adapted to be connected to a liquid line 12, such as an outside water conduit of a dwelling. The water line comprises a spigot 14 having a manually actuable valve. The unit 10 comprises a conduit 16 formed of any suitable material, e.g., copper, aluminum, iron, stainless steel. The conduit 16 comprises a pair of rigid pipes 18, 20, a first of the pipes 18 forming an upwardly inclined inlet end 15 of the conduit 16, and a second of the pipes 20 forming an outlet end of the conduit 16. The first pipe 18 includes a horizontal portion 19 extending from the inclined portion. The inlet end carries a fastener 22, such as a conventional internally threaded hose coupling that is connectible to the external threads of the spigot 12. Such a hose coupling comprises an internally threaded sleeve rotatably mounted at an inlet end of the pipe.

Mounted on the first pipe 18 is a temperature sensor 24 adapted to directly measure the temperature of an outside surface of the first pipe 18. Such a sensor comprises a conventional thermal switch marketed by Motor and Armature, Inc. of P.O. Box 255, Hauppaute, N.Y. under the name Klixon. Such a switch is commonly used in refrigeration systems to sense the temperature of fluid within a refrigeration conduit. That is, the thermal switch includes a housing 26 containing a bimetallic element and a set of electrical contacts. A wrap-around strap 28 secures the housing 26 to the pipe 18. The bimetallic element is situated to contact and sense the temperature of the outer surface of the pipe and activate, e.g., close, the electrical contacts when that temperature descends to a predetermined level. That sensed temperature very closely approximates the temperature of the liquid within the pipe since the liquid temperature is conducted through the wall of the pipe. Since the rate at which such temperature conduction occurs is a function of the thermal conductivity of the pipe, it is desirable to utilize a conduit of relatively high thermal conductivity.

Mounted at an end of the first pipe 18 opposite the coupling 22 is a valving mechanism 30, preferably a conventional electric solenoid type valving mechanism marketed by Richdel Industrial Products and available from Welthy, Inc. of P.O. Box 1472, Brooksville, Florida. That valve includes an inlet 32 and an outlet 34 and contains a normally closed two-way diaphragm action, pilot operated valve interposed between the inlet and outlet for controlling the liquid flow. An electric solenoid 36 governs the diaphragm action to open the valve. A manual flow control knob 38 is provided to adjust the rate of fluid flow when the valve is in an opened mode. In the present invention, then, the trickling rate would be set by the user. A manual bleed valve 40 is provided which is manually actuable to establish a fluid flow through the valve independently of actuation of the solenoid.

The inlet 32 of the solenoid valve 30 is threadedly coupled to the first pipe 18, and the outlet 34 of the valve is threadedly coupled to the second pipe 20.

The switch 24 and valve 30 are connected in an electrical circuit which includes an electrical power source such as an A.C. or D.C. current source. The D.C. current source could comprise a battery. The A.C. source could comprise a plug-in type electrical outlet.

In practice, whenever an occupant expects cold ambient temperatures, or will be unavailable to manually open the spigot, it is merely necessary to attach the unit 10 to the spigot 12 by means of the threaded coupling 22. If the unit 10 is battery-operated no further preparation is necessary. If the unit is A.C. actuated, it is merely necessary to insert a suitable plug of the solenoid into an accessible electric A.C. outlet. The unit is thus immediately prepared for operation once the manual spigot valve 14 is opened.

In the event that the ambient temperature descends to such a level that the water in the first pipe 18 approaches a freezing temperature, the thermal switch 24 actuates the solenoid 36 to open the normally-closed valve 30 and permits water to trickle therethrough at the preadjusted rate. Eventually, when warmer water enters the first pipe, (either from inside the dwelling or from below ground) and is sensed by the thermal switch 24, the solenoid will be deactuated to close the valve 30 until such time as the water in the first pipe 18 approaches its freezing temperature. If it is desired to establish a water flow through the unit 10, it is merely necessary to actuate the bleed 40. Alternatively, or additionally, there can be provided a manual switch 50 in circuit with the thermal switch 24. By closing the switch 50, the valve 30 will open independently of the thermal switch 24.

It will be appreciated that the unit can be easily installed and removed by any person. Also, the unit can be removed when desired, thereby avoiding the inconvenience of having to deal with a permanent-type installation. Since the actuation of the unit depends upon the water temperature within the conduit, the unit will only operate to trickle water when there exists a real danger that freezing may occur, thus minimizing water waste. Also, since the unit is able to turn-off in response to the arrival of warmer water in the first pipe 18, less water will be wasted as compared with a unit which remains "on" until the ambient temperature rises above the freezing level. Furthermore, a water flow can be created through the unit even while the unit is attached to the spigot.

The present invention is applicable to any type of liquid conduit which is subject to freeze-up, such as for example, fire hydrants.

Although the present invention has been described in connection with a preferred embodiment thereof, it will be appreciated by those skilled in the art that additions, modifications, substitutions, and deletions not specifically described, may be made, without departing from the spirit and scope of the invention as defined in the appended claims.

What I claim is:

1. An automatic liquid flow control unit adapted to be attached to a liquid line to enable liquid to trickle therethrough in order to avoid liquid freeze-up, said unit comprising:

a rigid conduit means having an inlet including threaded fastening means for attaching said inlet to said liquid line, an electrical conduit, a solenoid-actuated pilot valve mounted to said conduit means downstream of said inlet and being in a normally closed state to prevent the passage of liquid therethrough, said valve including an electric solenoid connected to said electric circuit to be actuable to open said valve to a predetermined trickling mode wherein liquid trickles through said conduit means, and temperature sensitive switch means mounted against an outer surface of said conduit upstream of said valve and downstream of said fastening means and arranged for sensing the temperature of said outer surface and being electrically connected to said electrical conduit and said solenoid for actuating said solenoid to open said valve to said liquid-trickling mode in response to the sensed temperature approaching the freezing temperature of the liquid, said valve including a manual bleed valve means for actuating said pilot valve independently of said temperature sensitive switch means to establish a flow rate greater than said trickling mode.

2. A unit according to claim 1, wherein said valve includes manual means for adjusting the rate of trickle.

3. A unit according to claim 1, wherein said electrical circuit includes a storage battery.

4. A unit according to claim 1, wherein said conduit comprises first and second rigid pipes connected to inlet and outlet ends of said valve, respectively.

5. A unit according to claim 1, wherein said threaded fastening means comprises internal threads connectible to external threads of a liquid line.

6. A unit according to claim 1, wherein said manual means comprises a switch in said electrical circuit for supplying power to said valve means independently of said temperature sensitive switch means.

7. An automatic liquid flow control unit adapted to be attached to an externally threaded spigot to enable liquid to trickle therethrough in order to avoid liquid freeze-up, said unit comprising:

rigid conduit means having a horizontal portion and an upwardly inclined inlet portion which includes internally threaded fastening means for attaching said inlet to said externally threaded spigot, an electric circuit, a solenoid-actuated pilot valve mounted to said horizontal portion of said conduit means downstream of said inlet and being in a normally closed state to prevent the passage of liquid therethrough, said valve including an electric solenoid connected to said electric circuit to be actuable to open said valve to a predetermined trickling mode wherein liquid trickles through said conduit means, and temperature sensitive switch means mounted against an outer surface of said horizontal portion of said conduit upstream of said valve for sensing the temperature of said outer surface and being electrically connected to said electrical circuit and said solenoid for actuating said solenoid to open said valve to said liquid-trickling mode in response to the sensed temperature approaching the freezing temperature of the liquid, said valve including manual bleed valve means for actuating said pilot valve independently of said temperature sensing switch means to establish a flow rate greater than said trickling mode.

* * * * *